US007515028B1

(12) United States Patent
Sato et al.

(10) Patent No.: US 7,515,028 B1
(45) Date of Patent: Apr. 7, 2009

(54) COIL COMPONENT

(75) Inventors: Shinichi Sato, Tokyo (JP); Satoshi Kurimoto, Tokyo (JP); Makoto Morita, Tokyo (JP); Akira Takashima, Tokyo (JP); Sumio Takahashi, Tokyo (JP); Yoshiaki Kitajima, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/213,753

(22) Filed: Jun. 24, 2008

(51) Int. Cl.
*H01F 5/00* (2006.01)

(52) U.S. Cl. ..... 336/200

(58) Field of Classification Search ..... 336/65, 336/83, 200, 220–223, 232; 29/605
See application file for complete search history.

(56) References Cited

U.S. PATENT DOCUMENTS

| | | | | |
|---|---|---|---|---|
| 7,071,803 | B2 * | 7/2006 | Oki | 336/83 |
| 7,209,022 | B2 * | 4/2007 | Kuroiwa et al. | 336/83 |
| 7,310,871 | B2 * | 12/2007 | Kuroiwa et al. | 29/605 |

FOREIGN PATENT DOCUMENTS

| | | |
|---|---|---|
| JP | A-03-163808 | 7/1991 |
| JP | A-7-263251 | 10/1995 |
| JP | A-9-213539 | 8/1997 |
| JP | A-9-270316 | 10/1997 |
| JP | A-2001-35729 | 2/2001 |
| JP | A-2004-95673 | 3/2004 |
| JP | A-2005-45052 | 2/2005 |
| JP | A-2005-210055 | 8/2005 |
| JP | A-2005-217280 | 8/2005 |
| JP | A-2007-173573 | 7/2007 |
| JP | A-2007-173576 | 7/2007 |

* cited by examiner

*Primary Examiner*—Tuyen T. Nguyen
(74) *Attorney, Agent, or Firm*—Oliff & Berridge, PLC

(57) ABSTRACT

A coil component having a low profile and being conducive to high-density mounting. The coil component includes a core 2 having a coil winding portion, and first and second flanges disposed on either end of the coil winding portion. The second flange is adapted to be mounted on a circuit board, and is configured of a substantially octagonal bottom surface having first and second peripheral surfaces and first through fourth omitted peripheral surfaces. The first terminal electrode is disposed across the first omitted peripheral surface and a part of the bottom surface, and the second terminal electrode is disposed across the second omitted peripheral surface and part of the bottom surface separated from the first terminal electrode. A winding is wound over the coil winding portion and has a first end electrically connected to the first terminal electrode at the first omitted peripheral surface, and a second end electrically connected to the second terminal electrode at the second omitted peripheral surface.

4 Claims, 4 Drawing Sheets

COIL COMPONENT

TECHNICAL FIELD

The present invention relates to a coil component, and more particularly, to a coil component having a drum core.

BACKGROUND

Conventionally, a coil component having a core with a coil winding portion and flanges on both ends of the coil winding portion and a winding wound over the coil winding portion have been used in an electronic device for noise suppression. When mounting the coil component on the circuit board, an end face of one flange is ordinarily used as a mounting surface for stability considerations and the like.

Since electrodes are formed on the circuit board, terminal electrodes are often disposed in the mounting surface of the coil component to be conductively connected to the electrodes on the circuit board. Here, and the winding is connected to the terminal electrodes, as described in Japanese Patent Application publication No. 2005-210055.

However, the requirements for high-density mounting in electronic devices have become more stringent in recent years with the increasing high performance of mobile telephones and the like. Therefore, efforts are being made to reduce the volume and height of coil component, as well as the gap between adjacent coil components.

However, when the winding is connected to terminal electrodes at the mounting surface, the height of the coil component is increased by the height or diameter of the winding. The JP publication also describes forming a depression in the mounting surface and connecting the winding within this depression. However, since the shape of the core component is more complex in this case, the core component is more difficult to manufacture, and the strength of the core component may be lowered.

SUMMARY

Further, because the mounting portion of the coil component cannot be seen when mounting the coil component on the circuit board, some coil components are constructed with the electrodes on the peripheral surface of the flange. However, this sometimes causes short-circuiting between electrode parts when adjacent coil components are placed close together. As a result, adjacent coil components must be separated a certain distance in this case, which is problematic when striving for high-density mounting.

It is therefore an object of the present invention to provide a coil component having a low profile and being conducive to high-density mounting.

This and other object of the present invention will be attained by a coil component including a core, a winding, and terminal electrodes. The core includes a coil winding portion having one axial end and another axial end, a first flange disposed on the one axial end and defining a first end face of the core, and a second flange disposed on the another axial end and defining a second end face of the core. The first flange has a bottom surface constituting the first end face and a peripheral surface extending toward the second end face from a peripheral edge of the bottom surface. The bottom surface has a first side and a second side opposing the first side, a first omitted side at a first end of the first side, and a second omitted side at one of a first end and a second end of the second side. The first omitted side is configured as if a first corner located on a first end of a first specific side (corresponding to the first side) of an imaginary quadrangle is chamfered or cut. The second omitted side is configured as if a second corner located on one of first end and second end of a second specific side (corresponding to the second side) of the imaginary quadrangle is chamfered or cut. The peripheral surface has a first peripheral surface extending from the first side, a second peripheral surface extending from the second side, a first omitted peripheral surface extending from the first omitted side adjacent to the first peripheral surface, and a second omitted peripheral surface extending from the second omitted side adjacent to the second peripheral surface. The winding is wound about the coil winding portion and has a first end and a second end. The terminal electrodes disposed on the first flange and include a first terminal electrode and a second terminal electrode. The first terminal electrode is disposed across the first omitted peripheral surface and a part of the bottom surface. The second terminal electrode is disposed across the second omitted peripheral surface and another part of the bottom surface separated from the first terminal electrode. The first end of the winding is electrically connected to the first terminal electrode at the first omitted peripheral surface and, the second end of the winding is electrically connected to the second terminal electrode at the second omitted peripheral surface.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
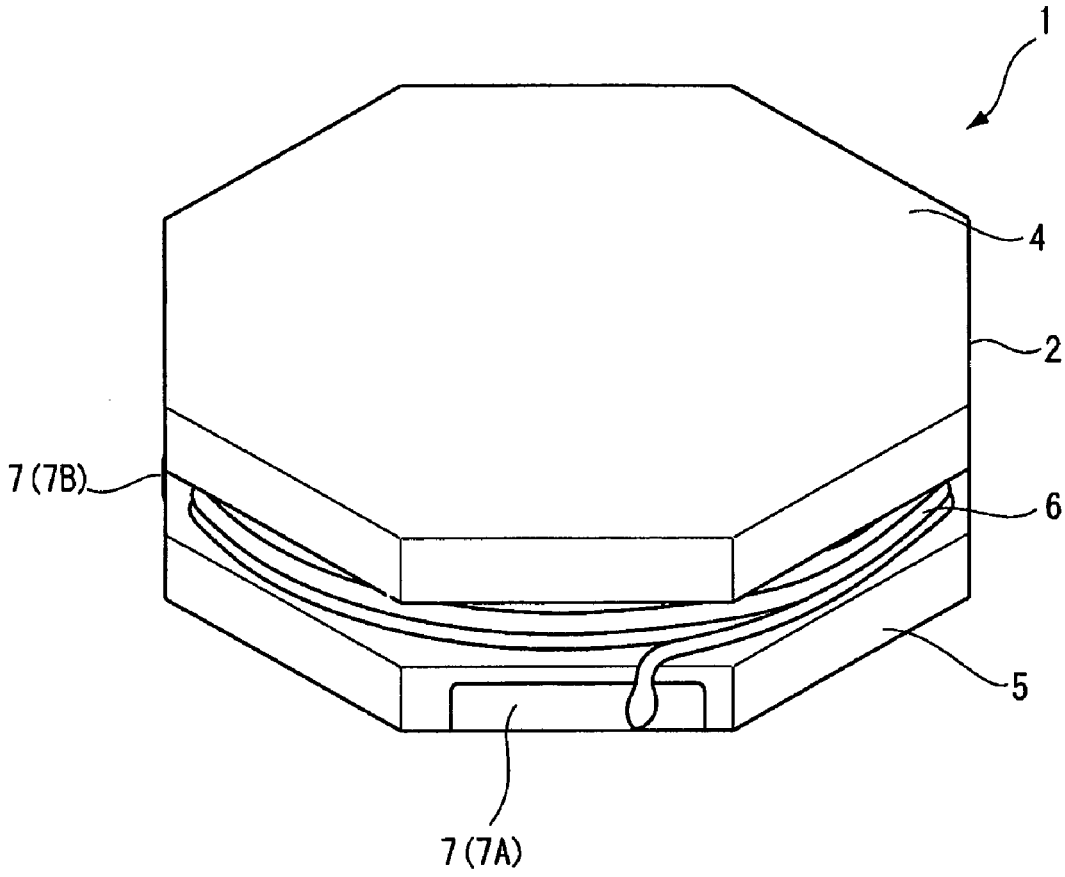
FIG. 1 is a perspective view of a coil component according to one embodiment of the present invention.

A coil component according to one embodiment of the present invention will be described with reference to FIGS. 1 through 4. A coil component 1 shown in FIG. 1 primarily includes a core 2, a single winding 6, and terminal electrodes 7.

The core 2 is basically made from a magnetic material such as ferrite and includes a substantially cylindrical coil winding portion 3 (FIG. 2), and a first flange 4 and a second flange 5 disposed one on either end of the coil winding portion 3. Since the first and second flanges 4 and 5 are symmetrical in shape, only the second flange 5 will be described below.

Figure 3:
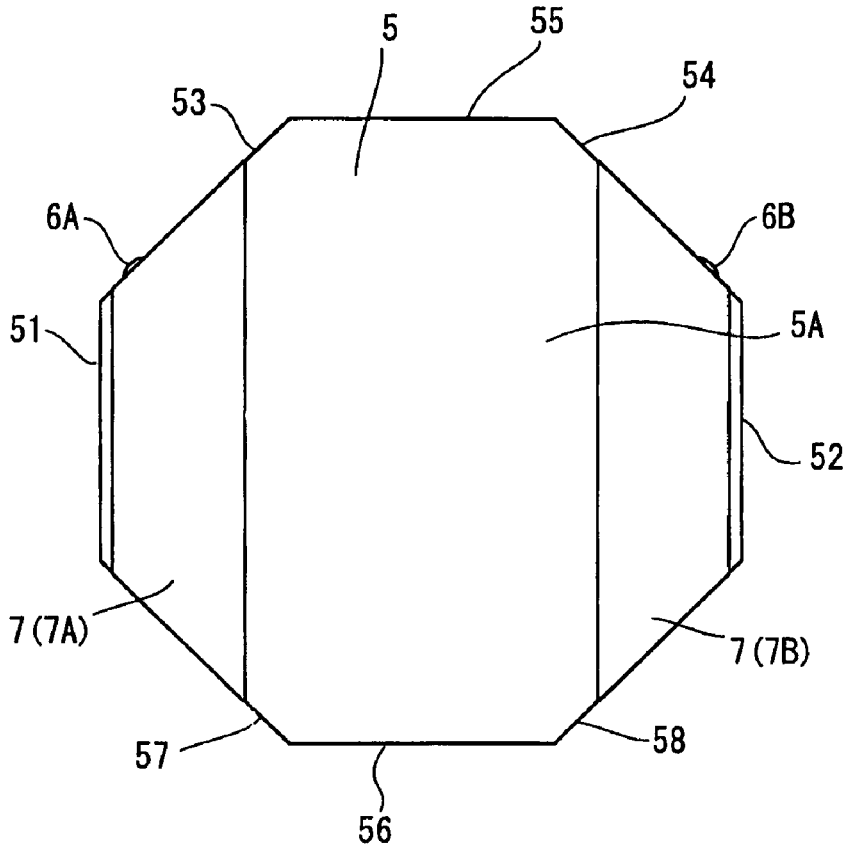
FIG. 3 is a bottom view of the coil component according to the embodiment.

The second flange 5 is substantially plate-shaped with a prescribed thickness. The second flange 5 has a bottom surface 5A that is substantially octagonal in shape. As shown in FIG. 3, the bottom surface 5A has a first side 51, a second side 52, a first omitted side 53, a second omitted side 54, a third side 55, a fourth side 56, a third omitted side 57, and a fourth omitted side 58. These sides have length equal to one another.

The first and second sides 51 and 52 are parallel sides, the first and second omitted sides 53 and 54 are disposed on one side of the first and second sides 51 and 52. The third and fourth omitted sides 57 and 58 are disposed on the other side of the first and second sides 51 and 52. The third side 55 is provided between the first and second omitted sides 53 and 54, and the fourth side 56 is provided between the third and fourth omitted sides 57 and 58. The third and fourth sides 55 and 56 are substantially parallel. These sides 51-58 constitute the peripheral edge of the bottom surface 5A.

When the coil component 1 is mounted on a circuit board, the first, second, third, and fourth sides 51, 52, 55, and 56 are substantially in contact with or in close proximity to the electronic parts of other neighboring coil components. When viewing the bottom surface 5A along the direction of a line connecting the first and second flanges 4 and 5, the first, second, third, and fourth omitted sides 53, 54, 57, and 58 constitute the beveled four corners of an imaginary square constructed by extending each of the first, second, third, and fourth sides 51, 52, 55, and 56. This configuration inhibits the first, second, third, and fourth omitted sides 53, 54, 57, and 58 from substantially coming into contact with other electronic parts. The bottom surface 5A forms one end face of the core 2 and serves as a mounting surface by which the coil component 1 is surface-mounted on a circuit board (not shown).

Figure 2:
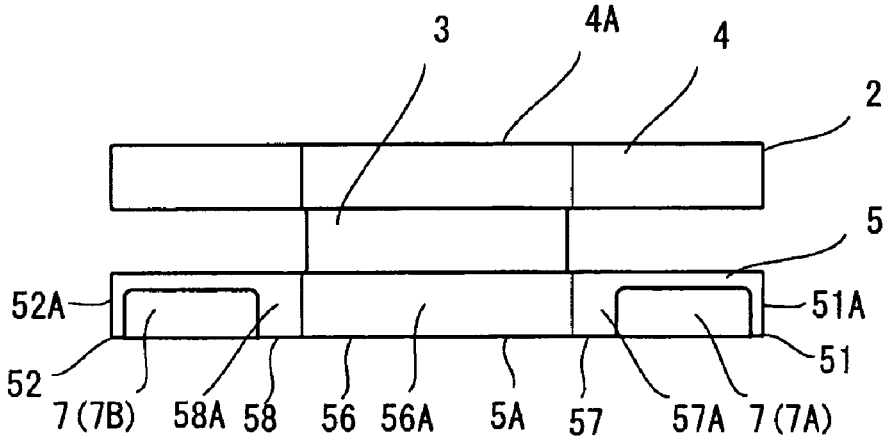
FIG. 2 is a rear view of a core in the coil component according to the embodiment.
Figure 4:
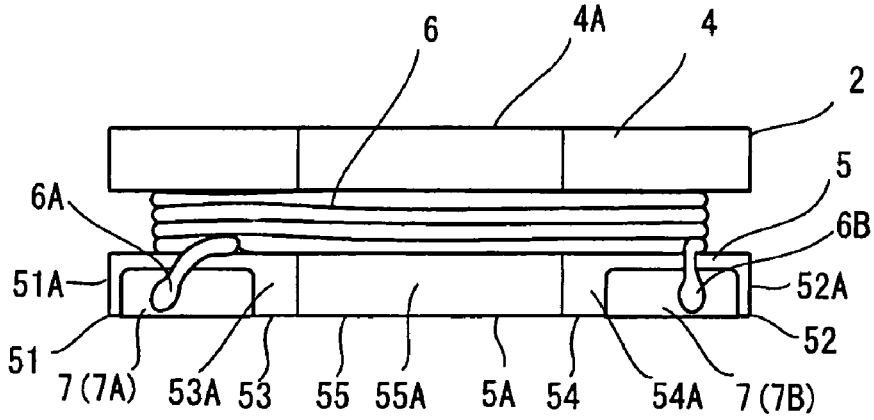
FIG. 4 is a front view of the coil component according to the embodiment.

As shown in FIG. 4, a top surface 4A is defined on the first flange 4 as the other end face of the core 2. As shown in FIGS. 2 and 4, the second flange 5 has a first peripheral surface 51A, a second peripheral surface 52A, a first omitted peripheral surface 53A, a second omitted peripheral surface 54A, a third peripheral surface 55A, a fourth peripheral surface 56A, a third omitted peripheral surface 57A, and a fourth omitted peripheral surface 58A as the peripheral surface extending from the peripheral edge of the bottom surface 5A toward the top surface 4A. The peripheral surfaces 51A-58A extend from the corresponding sides 51-58.

The winding 6 is a copper wire having an insulating coating and is wound about the coil winding portion 3. The winding 6 has a first end 6A and a second end 6B electrically connected to the terminal electrodes 7.

The terminal electrodes 7 include a first terminal electrode 7A and a second terminal electrode 7B. As shown in FIGS. 2-4, the first terminal electrode 7A is provided across the first omitted peripheral surface 53A, a portion of the bottom surface 5A, and the third omitted peripheral surface 57A. The second terminal electrode 7B is provided across the second omitted peripheral surface 54A, a portion of the bottom surface 5A separated from the first terminal electrode 7A, and the fourth omitted peripheral surface 58A. The first end 6A of the winding 6 is electrically connected to the first terminal electrode 7A at a portion of the first omitted peripheral surface 53A, while the second end 6B of the winding 6 is electrically connected to the second terminal electrode 7B at a portion of the second omitted peripheral surface 54A.

Figure 5:
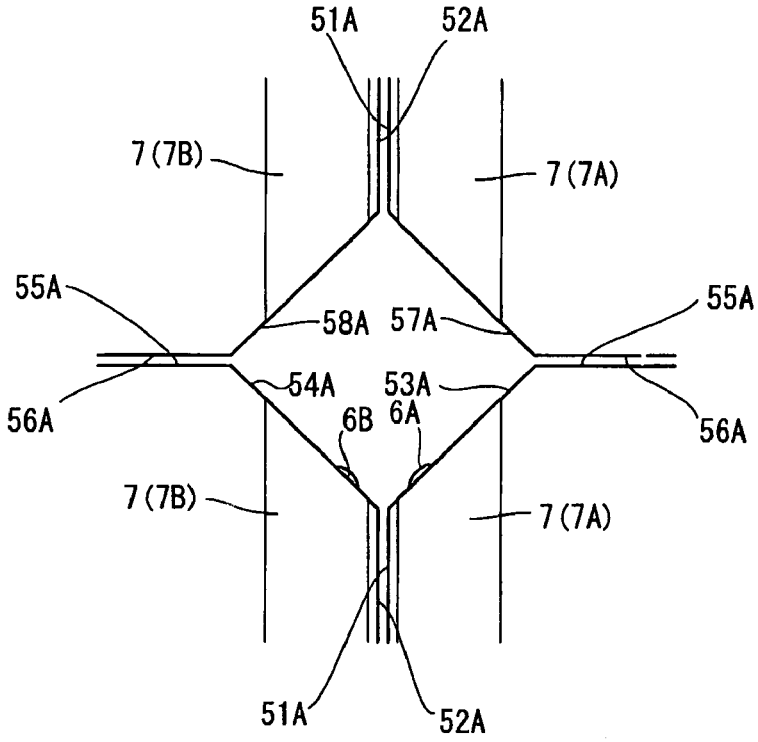
FIG. 5 is a partial bottom view showing an arrangement of a plurality of coil components according to the embodiment.

FIG. 5 shows an arrangement of coil components 1 having the above construction on a circuit board (not shown). The plurality of coil components 1 are mounted such that the first peripheral surface 51A of one coil component 1 is adjacent to the second peripheral surface 52A of another coil component 1, and the third peripheral surface 55A of one coil component 1 is adjacent to the fourth peripheral surface 56A of still another coil component 1. With this arrangement, the first omitted peripheral surface 53A of one coil component 1 neighbors the second omitted peripheral surface 54A of another coil component 1. However, since the first and second omitted peripheral surfaces 53A and 54A are formed by chamfering the respective first and second peripheral surfaces 51A and 52A, the first and second terminal electrodes 7A and 7B formed on the respective first and second omitted peripheral surfaces 53A and 54A are inhibited from contacting each other directly or via solder fillets and short-circuiting. Similarly, although the first omitted peripheral surface 53A of one coil component 1 neighbors the third omitted peripheral surface 57A of another coil component 1, since both surfaces are formed by chamfering, the first and second terminal electrodes 7A and 7B are inhibited from contacting and short-circuiting. Accordingly, the coil components 1 can be mounted at a high density.

Further, since the winding 6 is electrically connected to the terminal electrodes 7 at the first and second omitted peripheral surfaces 53A and 54A, the winding 6 does not reach the bottom surface 5A by which the coil component 1 is mounted. Therefore, the height of the coil component 1 is defined merely by the distance from the bottom surface 5A forming one end face of the core 2 to the top surface 4A forming the other end face, enabling the coil component 1 to be formed at a low height. Further, by connecting the ends of the winding at the first and second omitted peripheral surfaces 53A and 54A, the connected parts can easily be seen after the coil component 1 is mounted on a circuit board. Thus, this construction facilitates external inspection of fillets and the like after the coil component 1 is mounted.

Figure 6:
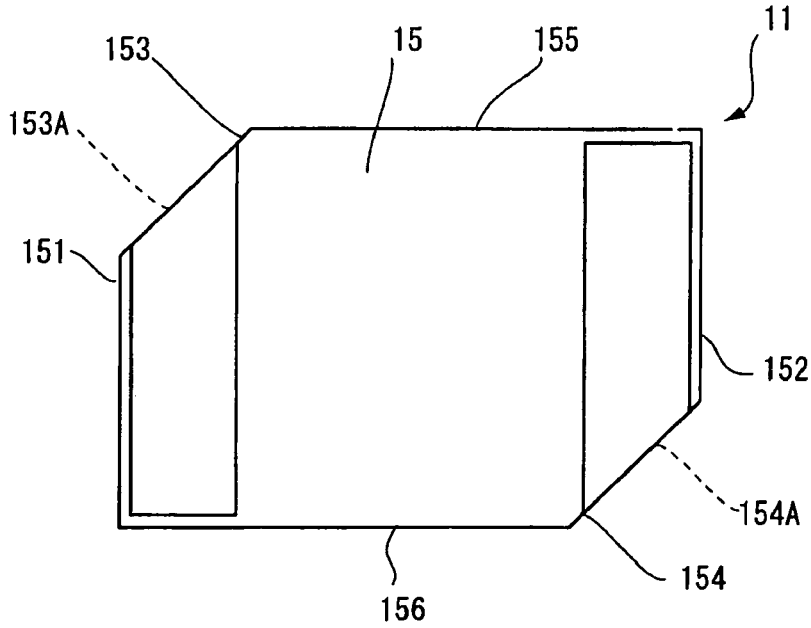
FIG. 6 is a bottom view of a coil component according to a first modification to the embodiment.

FIG. 6 shows a coil component 11 according to a first modification to the embodiment. The coil component 11 has a second flange 15 in which only a first omitted side 153 and a second omitted side 154 are formed. With this construction, ends of the winding are connected to a first omitted peripheral surface 153A extending from the chamfered first omitted side 153, and a second omitted peripheral surface 154A extending from the chamfered second omitted side 154, making it possible to form a low coil component and suitable for high-density mounting. Incidentally, the second omitted side 154 may be formed in the second flange 15 by chamfering the corner formed by a second side 152 and a third side 155.

Figure 7:
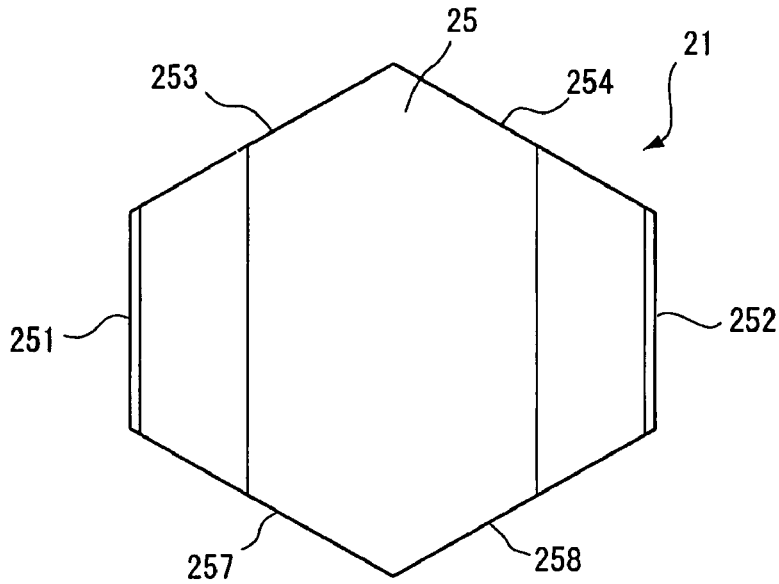
FIG. 7 is a bottom view of a coil component according to a second modification to the embodiment.

FIG. 7 shows a coil component 21 according to a second modification to the embodiment. The coil component 21 has a bottom surface 25 of a hexagonal shape defined by a first side 251, a second side 252, a first omitted side 253, a second omitted side 254, a third omitted side 257, and a fourth omitted side 258. This shape inhibits the first omitted side 253 of one coil 21 and the second omitted side 254 of another coil 21 from contacting each other and short-circuiting through solder fillets or the like when a plurality of the coil components 21 are mounted on a circuit board (not shown).

Figure 8:
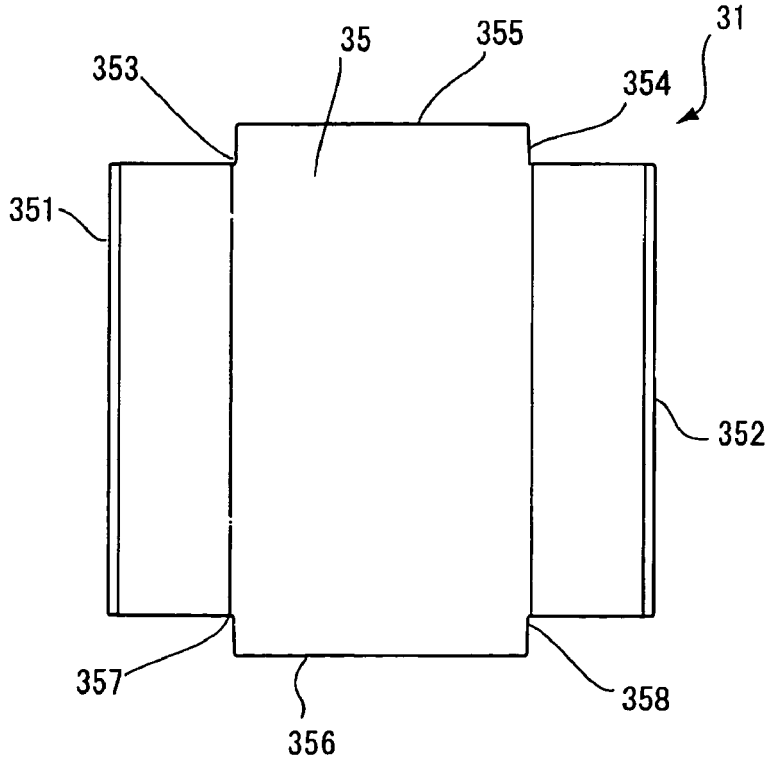
FIG. 8 is a bottom view of a coil component according to a third modification to the embodiment.

FIG. 8 shows a coil component 31 according to a third modification to the embodiment. In this coil component 31, the corners of a quadrangle formed by a first side 351, a second side 352, a third side 355, and a fourth side 356 are cut out to form a first omitted side 353, a second omitted side 354, a third omitted side 357, and a fourth omitted side 358. The coil component 31 having this construction can obtain the same effects as the coil component 1 of the above-described embodiment.

While the invention has been described in detail with reference to the specific embodiment thereof, it would be apparent to those skilled in the art that various changes and modifications may be made therein without departing from the spirit of the invention.

The invention claimed is:

1. A coil component comprising:

a core comprising a coil winding portion having one axial end and another axial end, a first flange disposed on the one axial end and defining a first end face of the core, and a second flange disposed on the another axial end and defining a second end face of the core, the first flange having a bottom surface constituting the first end face and a peripheral surface extending toward the second end face from a peripheral edge of the bottom surface, the bottom surface having a first side and a second side opposing the first side, a first omitted side at a first end of the first side, and a second omitted side at one of a first end and a second end of the second side, the first omitted side being configured as if a first corner located on a first end of a first specific side of an imaginary quadrangle corresponding to the first side is chamfered or cut, and the second omitted side being configured as if a second corner located on one of first end and second end of a second specific side of the imaginary quadrangle corresponding to the second side is chamfered or cut, the peripheral surface having a first peripheral surface extending from the first side, a second peripheral surface extending from the second side, a first omitted peripheral surface extending from the first omitted side adjacent to the first peripheral surface, and a second omitted peripheral surface extending from the second omitted side adjacent to the second peripheral surface;

a winding wound about the coil winding portion and having a first end and a second end; and terminal electrodes disposed on the first flange and comprising a first terminal electrode and a second terminal electrode, the first terminal electrode being disposed across the first omitted peripheral surface and a part of the bottom surface, and the second terminal electrode being disposed across the second omitted peripheral surface and another part of the bottom surface separated from the first terminal electrode, the first end of the winding being electrically connected to the first terminal electrode at the first omitted peripheral surface and, a second end of the winding being electrically connected to the second terminal electrode at the second omitted peripheral surface.

2. The coil component according to claim 1, wherein the bottom surface further has a third omitted side and a fourth omitted side, the third omitted side being configured as if a third corner located on a second end of the first specific side of the imaginary quadrangle corresponding to the first side is chamfered or cut, and the fourth omitted side being configured as if a fourth corner located on remaining one of first end and second end of the second specific side of the imaginary quadrangle corresponding to the second side is chamfered or cut, the peripheral surface further including a third omitted peripheral surface extending from the third omitted side adjacent to the first peripheral surface, and a fourth omitted peripheral surface extending from the fourth omitted side adjacent to the second peripheral surface.

3. The coil component according to claim 2, wherein the first terminal electrode is disposed across the first omitted peripheral surface, the part of the bottom surface, and the third omitted peripheral surface, and wherein the second terminal electrode is disposed across the second omitted peripheral surface, the another part of the bottom surface separated from the first terminal electrode, and the fourth omitted peripheral surface.

4. The coil component according to claim 3, wherein the bottom surface has an octagonal shape formed by the chamfered first, second, third, and fourth omitted sides, and the peripheral surface corresponds to each side of the octagonal bottom surface.

* * * * *